US007048618B1

(12) United States Patent
Cramer

(10) Patent No.: US 7,048,618 B1
(45) Date of Patent: May 23, 2006

(54) TOOL HAVING AN ADJUSTABLE CURVED WORKING SURFACE AND A METHOD FOR USING THE TOOL

(76) Inventor: David K. Cramer, 1180 Route 9, Hudson, NY (US) 12534

( * ) Notice: Subject to any disclaimer, the term of this patent is extended or adjusted under 35 U.S.C. 154(b) by 34 days.

(21) Appl. No.: 10/939,900

(22) Filed: Sep. 13, 2004

(51) Int. Cl.
*B24B 23/00* (2006.01)

(52) U.S. Cl. ..... 451/59; 451/495; 451/525

(58) Field of Classification Search ..... 451/59, 451/28, 490, 495, 522, 523, 524, 525
See application file for complete search history.

(56) References Cited

U.S. PATENT DOCUMENTS

| | | | | |
|---|---|---|---|---|
| 1,707,207 | A | 3/1929 | Bianchi et al. | |
| 1,858,899 | A | 5/1932 | Montbriand | |
| 2,143,063 | A | 1/1939 | Fetterolf | 29/78 |
| 3,123,947 | A | 3/1964 | Rawley | |
| 3,699,729 | A | 10/1972 | Garvey et al. | 51/391 |
| 4,688,356 | A | 8/1987 | Madzgalla | 51/391 |
| 4,759,155 | A * | 7/1988 | Shaw | 451/524 |
| 4,944,128 | A | 7/1990 | Reiter | 51/363 |
| 5,283,988 | A * | 2/1994 | Brown | 451/524 |
| 5,387,251 | A | 2/1995 | Rouse | 451/495 |
| 5,700,187 | A | 12/1997 | Balbi | 451/495 |
| 5,947,803 | A * | 9/1999 | Gruner | 451/354 |
| 6,220,948 | B1 | 4/2001 | Carballo | 451/356 |
| 6,494,771 | B1 | 12/2002 | Carlson | 451/344 |
| 6,755,727 | B1 | 6/2004 | Bjerkhoel | 451/513 |

OTHER PUBLICATIONS

Stanley 8438905441 Drywall Hand Sander; www.oldhouseweb.comourStore/tools.
8438905447-Hand Sander; www.stanleytools.com.
JC's Online Toolshed; Sand Board 2-3/4 Inch ×17 Inch; jcsonlinetoolshed.com/product.php.
Jamestown Distributors; Long Board Stiff; Plastic 2¾"×17½"; Flexible Sanding Board; www.jamestowndistributors.com/eserv/eclipse.ecl.

* cited by examiner

*Primary Examiner*—Robert A. Rose
(74) *Attorney, Agent, or Firm*—John Pietrangelo; Heslin Rothenberg Farley & Mesiti P.C.

(57) ABSTRACT

A tool for supporting an abrasive material is disclosed. The tool may be used to abrade a surface, for example, for sanding. The tool includes a flexible base plate, a base plate curvature-adjusting device, a resilient pad with recesses, and clamps for mounting an abrasive sheet material upon the pad. The curvature-adjusting device includes a rotatable handle that engages the ends of the base plate and deflects the base plate to a desired curvature. The recesses in the pad retain abraded material and minimize build up of the abraded material on the abrasive sheet. Aspects of the invention may be used to abrade, for example, sand, any surface requiring material removal, for example, sheet rock or automobile body panels. A tool for spreading a material, such as an adhesive, on a surface is also disclosed; the curvature of the working surface of this tool may also be adjustable.

21 Claims, 6 Drawing Sheets

2443.001

TOOL HAVING AN ADJUSTABLE CURVED WORKING SURFACE AND A METHOD FOR USING THE TOOL

TECHNICAL FIELD

The present invention generally relates to tools having a curvilinear working surface whose curvature can be adjusted to vary the curvature of the surface. More particularly, the present invention relates to hand tools, for example, abrasive-bearing hand tools or material applying hand tools, having a curvilinear working surface the curvature of which can be varied to conform to the curvature of the surface being treated.

BACKGROUND INFORMATION

Mechanics often encounter non-planar surfaces that are often cumbersome, difficult or impossible to treat using conventional tools having flat, planar working surfaces. For example, curved surfaces requiring sanding, for instance, automobile body panels or curved residential archways, are often difficult to sand with conventional flat sanders or "long board" sanders. Similarly, applying materials, for example, adhesives or joint compounds, to curved surfaces is also cumbersome using conventional tools having flat, planar working surfaces, such as trowels and floats. The flat, typically rigid, surfaces provided by conventional tools simply do not conform to curvilinear surfaces and sanding to the desired shapes or spreading materials uniformly upon these surfaces is typically difficult and time consuming.

Thus, a need exists for tools having a curved working surface and methods for using these tools that address the limitations of the existing art. As will be discussed below, aspects of the present invention provide these tools and methods and markedly improve the ease and effectiveness with which curved surfaces can be treated, for example, by sanding and material application.

SUMMARY OF THE INVENTION

In order to address the limitations of the prior art as discussed above, a first aspect of the present invention provides a tool for supporting an abrasive material, the tool comprising a base plate having an upper surface, a lower surface, a first end, and a second end; a handle mounted between the first end and the second end; a pad mounted to the lower face of the base plate, the pad comprising an surface having at least some recesses; and means for mounting an abrasive sheet material upon the surface of the pad. In one aspect of the invention, the base plate comprises a flexible base plate, and the handle comprises an adjustable connecting means adapted to deflect at least one of the first end and the second end of the flexible base plate to thereby vary the curvature of the lower surface of the base plate.

Another aspect of the invention is a method of abrading a surface using a tool comprising a pad having an surface having a plurality of recesses; and a perforated abrasive sheet material mounted upon the resilient pad; the method comprising: passing the perforated abrasive sheet material across the surface wherein abraded surface material is produced; allowing the abraded surface material to pass through the perforations of the perforated abrasive sheet material; and collecting at least some of the abraded surface material in at least some of the plurality of recesses in the resilient pad to minimize the build-up of abraded surface material on the surface of the perforated abrasive sheet material. In one aspect of the invention, the plurality of recesses comprises a plurality of elongated recesses, and the method further comprises discharging the abraded surface material from the plurality of elongated recesses, for example, while passing the perforated abrasive sheet material across the surface.

A further aspect of the invention is a hand tool for supporting an abrasive material, the hand tool comprising a flexible base having an upper surface, a lower surface, a first end, and a second end; a rotatable cylindrical handle having a first end and a second end, the handle comprising an adjustable connecting means mounted between the first end and the second end, the adjustable connecting means adapted to deflect the first end and the second end of the flexible base wherein the curvature of the lower surface of the flexible base is varied; a resilient pad mounted to the lower face of the flexible base, the resilient pad having a plurality of elongated recesses; and a first clamp mounted proximate the first end and a second clamp mounted proximate the second end, the first clamp and the second clamp adapted to retain a perforated abrasive sheet material upon the resilient pad.

A further aspect of the invention is a tool for applying a material to a surface, the tool comprising: a flexible base having an upper surface, a lower surface, a first end and a second end; and an adjustable connecting means mounted between the first end and the second end, the adjustable connecting means adapted to deflect at least one of the first end and the second end to thereby vary the curvature of the lower surface.

A still further aspect of the invention is a method for applying a material to a surface using a tool comprising: a flexible base having an upper surface and a lower surface; and means for varying the curvature of the lower surface of the flexile base; the method comprising: adjusting the curvature of the lower surface to a desired curvature; applying the material to one of the lower surface and the surface; using the lower surface of the flexible base, spreading the material substantially uniformly on the surface.

These, and other aspects, features, and advantages of the present invention will become apparent from the following detailed description of the various aspects of the invention taken in conjunction with the accompanying drawings.

DETAILED DESCRIPTION OF THE INVENTION

Figure 1:
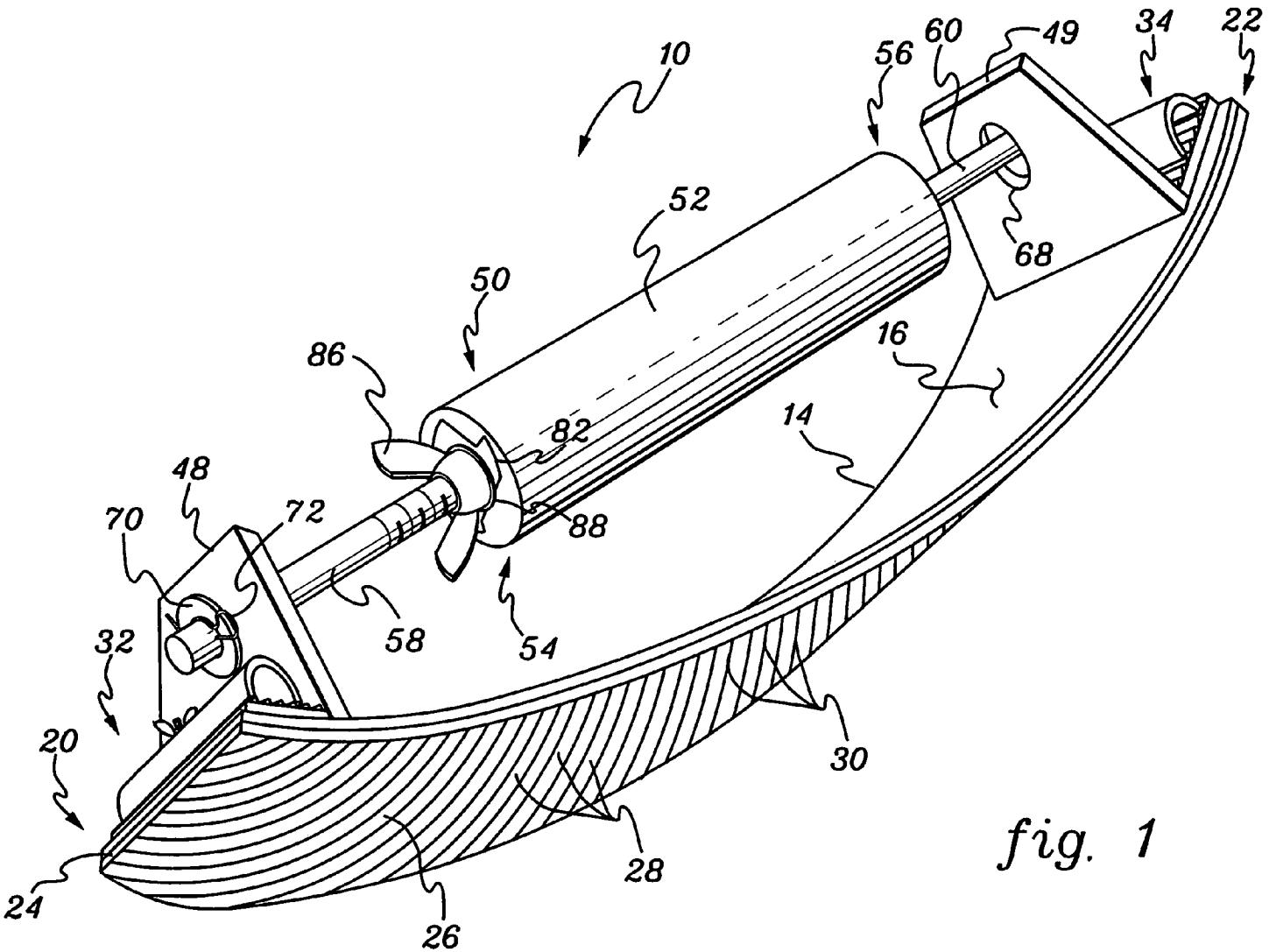
FIG. 1 is a perspective view of tool for supporting an abrasive material according to one aspect of the invention.
Figure 2:
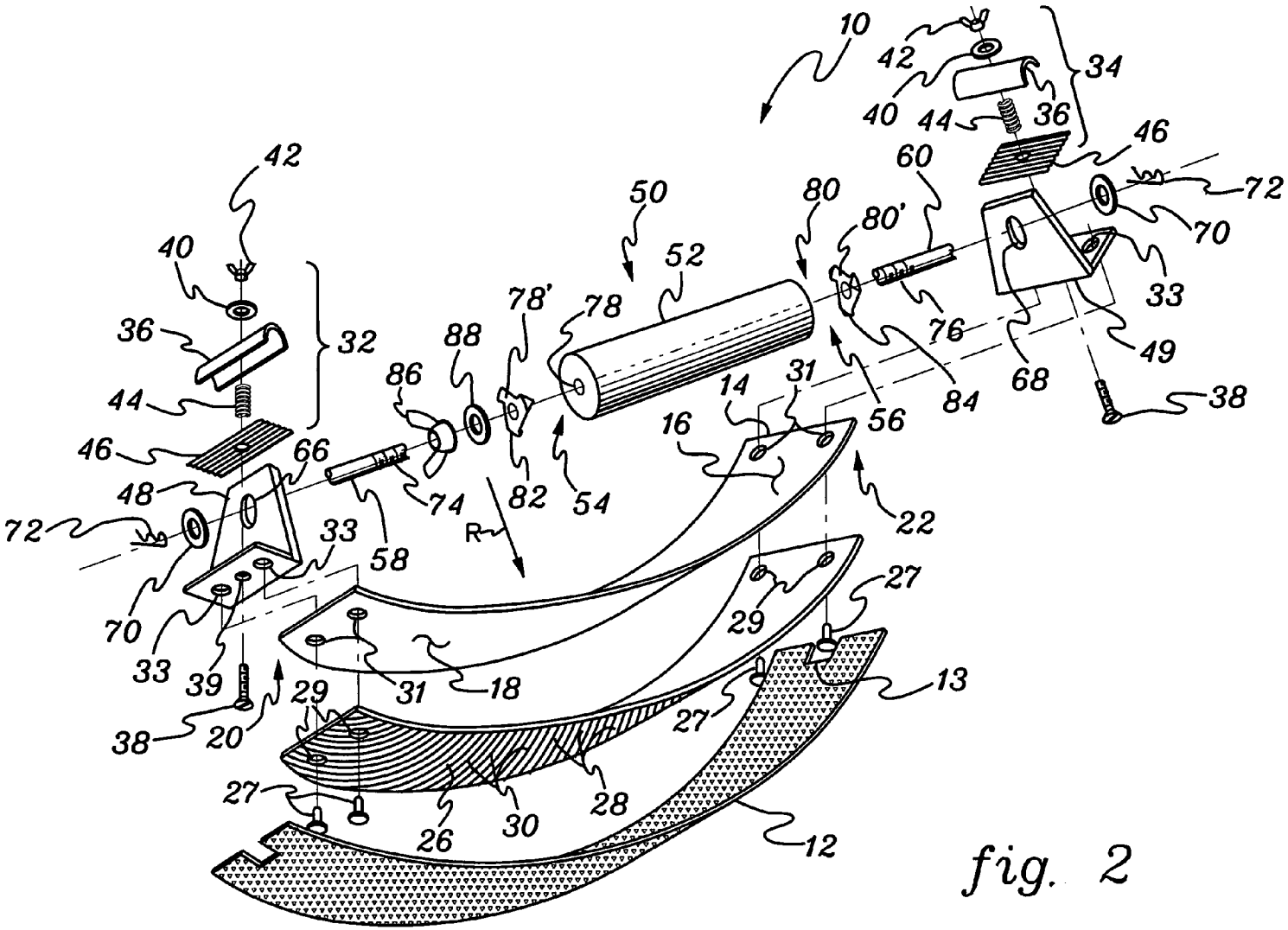
FIG. 2 is an exploded perspective view of the aspect of the invention shown in FIG. 1.

FIG. 1 is a perspective view of tool 10 for supporting an abrasive material according to one aspect of the invention. FIG. 2 is an exploded perspective view of tool 10 shown in FIG. 1 including a typical abrasive material 12 according to one aspect of the invention. The abrasive material 12 is omitted from FIG. 1 to facilitate illustration of this aspect of the invention. Tool 10 includes a base plate 14. Base plate 14 is typically flexible whereby the shape of base plate 14 may be varied to provide a range of curvatures, for example, as indicated by radius R in FIG. 2. Base plate 14 includes an upper surface 16, a lower surface 18, a first end 20, and a second 22.

As shown in FIGS. 1 and 2, base plate 14 may comprise a thin rectangular plate, but other conventional shaped plates may be used to effect the present invention, including round, oval, square, and the like. Base plate 14 may be metallic or non-metallic. For instance, base plate 14 may be made from one or more metals, such as steel, stainless steel, aluminum, titanium, nickel, magnesium, or any other structural metal. In one aspect of the invention, base plate 14 may be made from spring steel. Base plate 14 may also be non-metallic, for example, made from one or more of the following plastics: a nylon, a polyethylene (PE), a polypropylene (PP), a polyester (PE), a polytetraflouroethylene (PTFE), a acrylonitrile butadiene styrene (ABS), a polyvinylchloride (PVC), or a polycarbonate, for example, GE's Lexan® polycarbonate, among other plastics. Base plate 14 may typically be from about 3 inches long to about 6 feet long, but is typically between about 6 inches long and about 24 inches long, for example, about 12½ inches long. Base plate 14 may typically be from about 1 inch wide to about 12 inches wide, but is typically between about 2 inches wide to about 6 inches wide, for example, about 3¼ inches wide. Also, base plate 14 may typically be from about 1/64 inch thick to about 1 inch thick, but is typically between about 1/32 inch thick and about ¼ inch thick. Thickness will vary depending upon the material from which base plate 14 is made, for example, in one aspect, a Lexan base plate may be about ⅛ to 3/16 inches thick, and in another aspect, a spring steel base plate may be about 1/32 inch thick.

According to the aspect shown in FIGS. 1 and 2, tool 10 includes a pad 24, for example, a resilient pad, mounted to the lower surface 18 of base plate 14. Pad 24 may be made from any resilient material, for example, one of the plastics discussed above or from an elastomeric material, for example, one or more of natural rubber, neoprene, ethylene-propylene rubber (EDM/EPDM), urethane, polyurethane, styrene-butadiene rubber (SBR), isoprene rubber (IR), butadiene rubber (BR); room-temperature vulcanizing (RTV) silicone rubber, or their equivalent. Pad 24 may be mounted to the lower surface 18 of base plate 14 by conventional means, for example, using an adhesive or mechanical fasteners. According to one aspect of the invention, as shown in FIGS. 1 and 2, pad 24 may be mounted to base plate 14 by means of mechanical fasteners 27, for example, rivets, for instance, 3/16-inch by ¼-inch rivets, or their equivalent. Rivets 27 or other fasteners may pass through holes 29 in pad 24 and engage holes 31 in base plate 14. In one aspect, for example, when brackets 48 and 49 (discussed below) are welded to base plate 14, holes 29 and 31 may be omitted. In the aspect of the invention having brackets 48 and 49 (discussed below), rivets 27 or other fasteners may also engage holes 33 in brackets 48 and 49. In one aspect of the invention, pad 24 and brackets 48 and 49 may be mounted to base plate 14 using the same mechanical fasteners, such as rivets 27.

In one aspect of the invention, pad 24 includes a lower surface 26 having at least some recesses or cavities 28 and associated ribs or protrusions 30. In one aspect of the invention, ribs 30 provide a support surface for the abrasive material 12. In another aspect of the invention, recesses 28 provide voids in which abraded material produced when using tool 10 to abrade a surface may accumulate. In one aspect of the invention, recesses 28 not only provide voids into which abraded material may accumulate, but recesses 28 also provide a pathways through which accumulated abraded material may be discharged from tool 10. This aspect of the invention will be discussed in further detail below.

Figure 3:
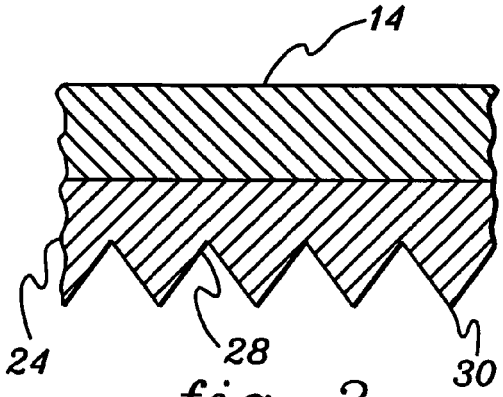
FIGS. 3 through 7 illustrate typical detailed views of cross-sections of the working surface of the tool shown in FIG. 1 according to aspects of the invention.
Figure 4:
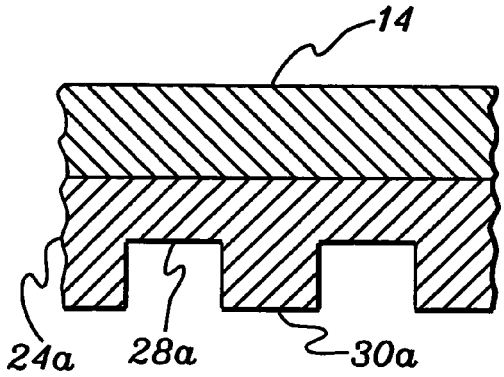
Figure 5:
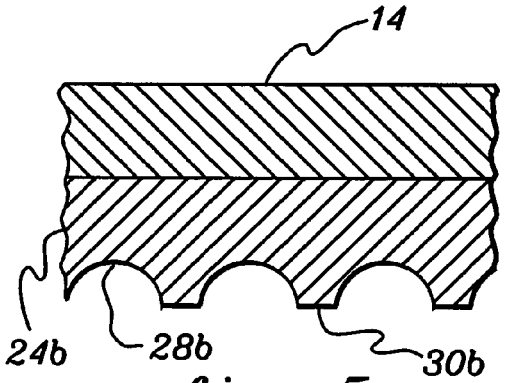
Figure 6:
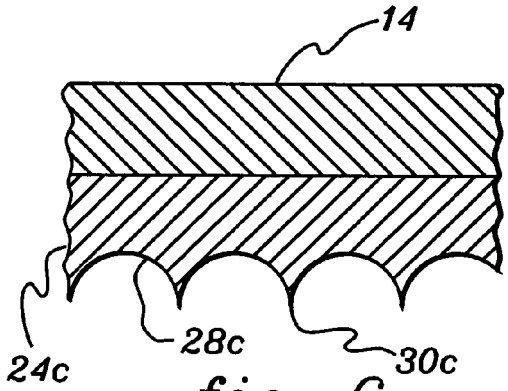
Figure 7:
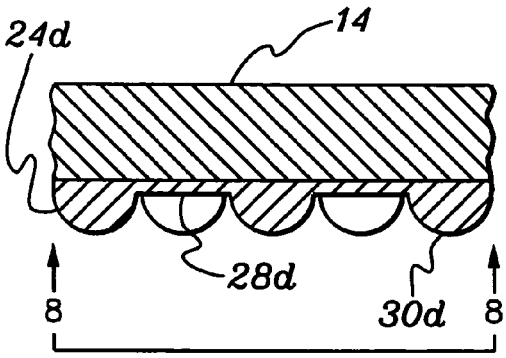
Figure 8:
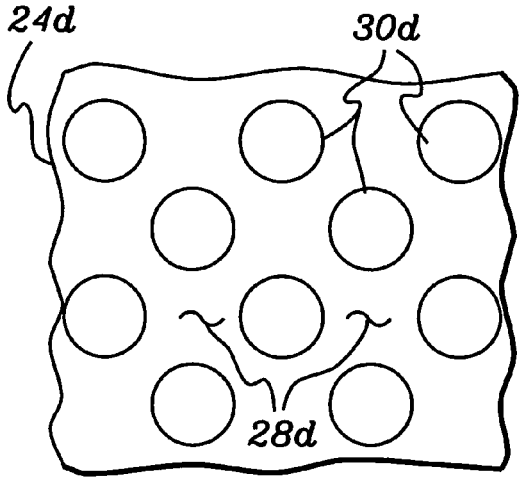
FIG. 8 is a plan view of the working surface shown in FIG. 7.

FIGS. 3 through 7 illustrates a detailed cross-sectional view of typical recesses 28 and ribs 30 that may be used according to aspects of the invention. According to one aspect of the invention, recesses 28 and ribs 30 may comprises many different shapes or geometries. As shown in FIG. 3, according to one aspect, pad 24 may comprise triangular recesses 28 into which abraded material may accumulate or pass through and triangular ribs 30 upon which abrasive material 12 may rest. As shown in FIG. 4, a pad 24*a* may comprise rectangular recesses 28*a* and rectangular ribs 30*a*; as shown in FIG. 5, a pad 24*b* may comprise circular or oval recesses 28*b* and rectangular ribs 30*b*; as shown in FIG. 6, a pad 24*c* may comprise circular or oval recesses 28*c* and substantially rounded or pointed ribs 30*c*; as shown in FIG. 7, a pad 24*d* may comprise circular or rectangular protrusions 28*d* and valleys 30*d* between protrusions 28*d*. FIG. 8 illustrates a plan view of pad 24*d* as viewed along view lines 8—8 shown in FIG. 7. As shown in FIG. 8, protrusions 28*d* may comprise protrusions adapted to support abrasive material 12 where valleys or voids 30*d* provide voids into which abraded material may accumulate and through which abraded material may pass. Protrusions 28*d* may be round, triangular, square, or rectangular, among other shapes. Protrusions 28*d* may also be rounded or non-rounded, for example, having planar tops.

In one aspect, the aspects illustrated in FIGS. 3 through 8 may be used to enhance one aspect of the invention. As noted earlier, in one aspect, the invention comprises a method of abrading a surface using a tool having a pad 24 having an surface 26 having a plurality of recesses 28–28*d* and a perforated abrasive sheet material 12 mounted upon pad 24. The method includes the steps of passing the perforated abrasive sheet material 12 across the surface wherein abraded surface material is produced; allowing the abraded surface material to pass through the perforations of the perforated abrasive sheet material 12; and collecting at least some of the abraded surface material in at least some of the plurality of recesses 28–28*d* in the pad 24 to minimize the build-up of abraded surface material on the surface of the perforated abrasive sheet material 12. In one aspect, the plurality of recesses comprises a plurality of elongated recesses 28–28*d*, and wherein the method further comprises discharging the abraded surface material from the plurality of elongated recesses 28–28*d*. In a further aspect, the discharging of the abraded surface material from the plurality of elongated recesses 28–28*d* is practiced while passing the perforated abrasive sheet material 12 across the surface. One of skill in the art will recognize that aspects of the invention illustrated in FIGS. 3 through 8 may enhance the collecting and discharging of the abraded material. For example, recesses 28–28*d* provide cavities for collecting abraded material and, in one aspect, the smooth curved surfaces of elongated recesses, for example, recesses 28*b* and 28*c*, allow for relatively unhindered discharge of abraded material from the respective recesses, for instance, as the tool 10 sweeps across the surface being abraded. For example, in one aspect, the movement of tool 10 across the surface being abraded propels the abraded material along elongated recesses 28–28*d* whereby abraded material is transported away from the surface of perforated abrasive sheet material 12. In one aspect, the buildup of abraded material on, within, or behind perforated abrasive sheet material 12 is minimized or prevented, and the process of abrading the surface is facilitated or made more efficient.

Figure 9:
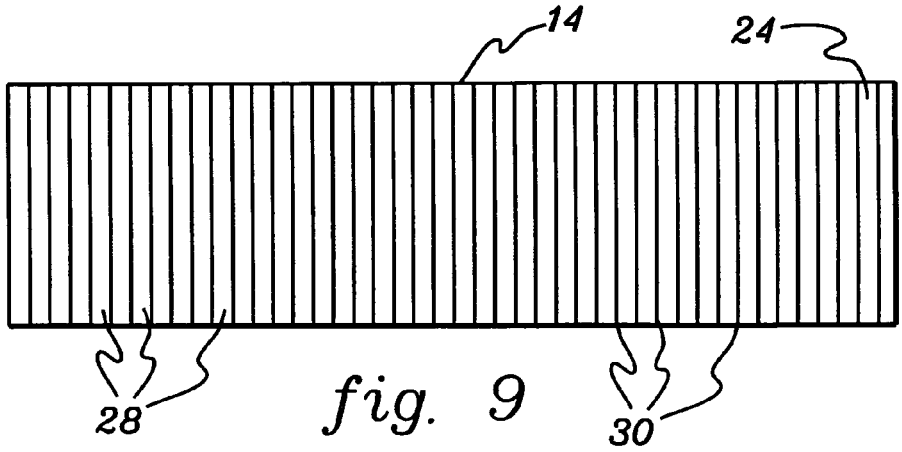
FIG. 9 is a bottom view of the aspect of the invention shown in FIG. 1 showing a configuration for the working surface according to one aspect of the invention.
Figure 10:
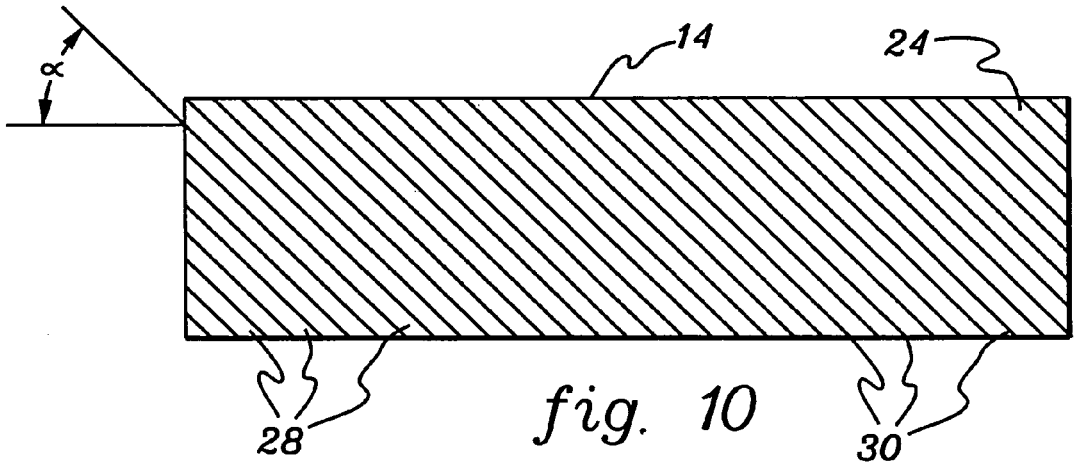
FIG. 10 is a bottom view similar to FIG. 9 showing another configuration for the working surface according to another aspect of the invention.
Figure 11:
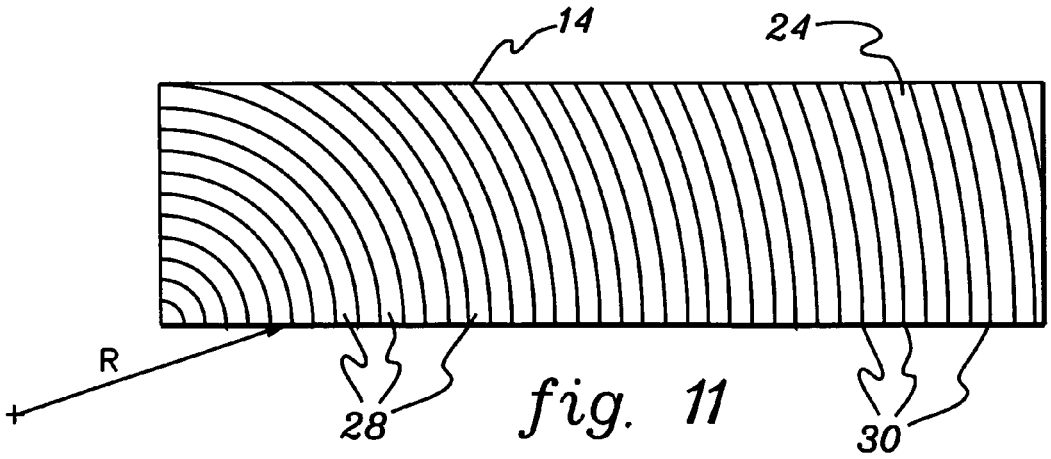
FIG. 11 is a bottom view similar to FIG. 9 showing another configuration for the working surface according to another aspect of the invention.

FIGS. 9, 10, and 11 illustrate bottom views of tool 10 according to several aspects of the present invention. As shown in FIGS. 9, 10, and 11, recesses 28–28*d* and ribs 30–30*d* in pads 24–24*d* may be provided in a broad range of regular patterns or styles. For example, as shown in FIG. 9, recesses 28 and ribs 30 may comprise a plurality of elongated recesses 28 and ribs 30, for example, parallel structures extending perpendicular to the direction of elongation of plate 14. In one aspect, recesses 28 and ribs 30 may also comprise parallel structures extending parallel to the direction of elongation of plate 14. As shown in FIG. 10, recesses 28 and ribs 30 may comprise parallel structures oriented at an angle $\alpha$ to either edge of plate 14. Angle $\alpha$ may range from about 2 degrees to about 88 degrees, but angle $\alpha$ may typically be between about 30 degrees and about 60 degrees, for example, about 45 degrees. As shown in FIG. 11, recesses 28 and ribs 30 may comprise parallel structures having a radius R. In one aspect, recesses 28 and ribs 30 comprise a pattern of arcuate elongated recesses and ribs, for example, having a common radius R; in another aspect, the radius R may vary. In one aspect of the invention, radius R is constant for all recesses 28 and ribs 30 of between about 6 inches and about 3 feet, for example, about 24 inches. Recesses 28–28*d* and ribs 30–30*d* in pads 24–24*d* shown in FIGS. 3 through 11 may be fabricated by machining, extrusion, or molding, among other methods. According to aspects of the invention, the pitch of ribs 30–30*d* may vary broadly. For example, in one aspect of the invention, the pitch of ribs 30–30*d* may vary from about 1 rib per inch to about 25 ribs per inch; however, in one aspect of the invention, the pitch of ribs 30–30*d* may vary from about 6 ribs per inch to about 12 ribs per inch, for example, 8 ribs per inch.

Returning to FIGS. 1 and 2, according to aspects of the present invention, tool 10 may include means for mounting an abrasive material to tool 10. In one aspect of the invention, the abrasive material may be an abrasive sheet material 12 (see FIG. 2) mounted to tool 10. In one aspect, abrasive sheet material 12 may be mounted wherein the sheet material 12 bears against lower surface 26 of pad 14, for example, against ribs 30. Abrasive sheet metal 12 may comprise any abrasive sheet material that is adapted to be mounted to tool 12. In one aspect, abrasive sheet material 12 may comprises sand paper, for example, a sand paper having a grit ranging from about 40 grit to about 600 grit provided by Norton Abrasives, or its equivalent. In one aspect of the invention, abrasive sheet material 12 may comprise a perforated sheet material. For example, in one aspect, abrasive sheet material 12 may comprise a sanding screen having a grit between about 60 grit and 220 grit provided by the 3M Company of St. Paul, Minn., or its equivalent. Abrasive sheet material 12 may be typically cut to accommodate the size of tool 10 and to accommodate the means for mounting to tool 12, for example, abrasive sheet 12 may have one or more cutouts 13 for accommodating the clamp assemblies 32 and 34 discussed below.

According to one aspect of the invention, the means for mounting an abrasive material to tool 10 may comprises any means for retaining an abrasive material 12, such as a sand paper or a sand screen, to lower surface 26 of pad 24. As shown in FIGS. 1 and 2, according to one aspect of the invention, the means for mounting abrasive sheet material to tool 10 may comprise a conventional clamp assembly mounted to ends 20 and 22 of base plate 14. For example, clamp assemblies 32 and 34 may be used to retain abrasive sheet 12 to tool 10. As shown most clearly in FIG. 2, clamp assemblies 32 and 34 each include retainers 36, for example, semi-cylindrical retainers 36. Retainers 36 may be releasably mounted to base plate 14 by means of screws 38, washers 40, and wing nuts 42. Screws 38 may pass through holes 39 in brackets 48 and 49 (discussed below). Clamp assemblies 32 and 34 may also include springs 44 and one or more gripping pads 46. Gripping pads 46 may comprise an elastomeric pad similar to pad 24, for example, a ribbed elastomeric pad that assists clamping devices 32 and 34 in retaining abrasive sheet material 12. Gripping pads 46 may be mounted to base plate 14 by conventional means, for example, using an adhesive or mechanical fasteners. According to one aspect of the invention, clamp assemblies 32 and 34 may not mounted directly to base plate 14, but may be mounted to one or more intermediate assemblies which may be mounted directly to base plate 14. For example, as shown in FIGS. 1 and 2, in one aspect, clamping assemblies 32 and 34 may be mounted to brackets 48 and 49 which are mounted directly to base plate 14, as will be discussed below.

According to one aspect of the present invention, tool 10 also includes a means for varying the curvature of the lower surface 18 of base plate 14. According to one aspect of the invention, this means for varying the curvature may comprise any means by which the desired result is effected, for example, any means for deflecting at least one of ends 20 and 22 of base plate 14 whereby the lower surface 18 of base plate 14 assumes a curved shape. However, according to one aspect of the invention, the means for varying the curvature of the lower surface 18 of base plate 14 comprises a connecting means 50, for example, an adjustable connecting means.

In one aspect of the invention, as shown in FIGS. 1 and 2, connecting means 50 comprises a cylindrical body 52 having a first end 54 and a second end 56 and at least one rod, typically at least two bars or rods 58 and 60, adapted to engage cylindrical body 52 and ends 20 and 22 of base plate 14. Rods 58 and 60 may engage cylindrical body 52 by conventional means, for example, by means of welding, one or more mechanical fasteners, an adhesive, or a combination thereof. As shown in FIGS. 1 and 2 cylindrical body 52 may be circular cylindrical; however, in aspects of the invention, cylindrical body 52 may have any suitable cross section, for example, elliptical or polygonal in cross section. For example, in one aspect, cylindrical body 52 may by triangular in cross section, rectangular in cross section, or may be ribbed or otherwise shaped to facilitate grasping and manipulation by a mechanic. In one aspect of the invention, cylindrical body 52 may be a handle, for example, a single rotatable handle. It will be understood by those of skill in the art, that the term handle is not limited to a structure that can be grasped manually by a human mechanic. In this context and in the claims, the term handle is used to mean a structure that can be used to interface tool 10 with any motive operator, including, but not limited to, a human mechanic and a robotic arm-end. In one aspect of the invention, cylindrical body 52 may be metallic or non-metallic; cylindrical body 52 may be made from one or more of the metals, plastics, or elastomers referenced with respect to base plate 14, or may be made from wood, for example, maple, birch, beech, or poplar, among other woods. Rods 58 and 60 may also be made from one or more of the metals or plastics referenced with respect to base plate 14, but in one aspect of the invention, rods 58 and 60 are made from stainless steel.

In one aspect of the invention, tool 10 also includes brackets 48 and 49 mounted on ends 20 and 22, respectively, of base plate 14. Brackets 48 and 49 may comprise the L-shaped structures shown in FIGS. 1 and 2 or any structure providing the desired function. Brackets 48 and 49 may be made from one or more of the metals or plastics discussed above with respect to base plate 14, but in one aspect of the invention brackets 48 and 49 are fabricated from aluminum. Brackets 48 and 49 may be mounted to base plate 14 by conventional means, for example, by means of welding, one or more mechanical fasteners, an adhesive, or a combination thereof. As shown in FIGS. 1 and 2, rods 58 and 60 engage brackets 48 and 49 whereby connecting means 50 engages first end 20 and second end 22 of base plate 14. Rods 58 and 60 may engage brackets 48 and 49, respectively, by conventional means, for example, by means of welding, one or more mechanical fasteners, an adhesive, or a combination thereof. In the aspect shown in FIGS. 1 and 2, rods 58 and 60 may engage brackets 48 and 49 by means of conventional mechanical fasteners. Specifically, brackets 48 and 49 may each include a hole or perforation 66, 68, through which an end of rods 58 and 60 may pass and then be regained in holes 66, 68 by a washer 70 and a cotter or hitch pin 72. In one aspect rods 58 and 60 may include a through hole or a notch through which cotter pin 72 may pass to engage rods 58 and 60.

In one aspect of the invention, connecting means 50 may not be adjustable. For example, in one aspect, cylindrical body 52 may be rigidly mounted to rods 58 and 60 wherein the curvature of the bottom surface of base plate 14 may be relatively fixed. In another aspect of the invention, connecting means 50 may comprise an adjustable connecting means.

In the aspect of the invention where connecting means 50 may be adjustable, in one aspect, rods 58 and 60 may be threaded rods 74, 76, for example, having conventional screw threads, for example, UNC, UNF, or Acme threads, extending at least partially along their length. According to this aspect of the invention, cylindrical body 50 may include at least hole, typically at least two holes 78, 80 positioned on either ends 54, 56, respectively, of cylindrical body 52. Holes 78 and 80 may be adapted to engage screw threads 74 and 76 of rods 58 and 60. In one aspect of the invention where cylindrical body 52 is made from a higher strength material, such as one or more of the metals mentioned above or a high-density plastic, holes 78 and 80 may be provided directly in cylindrical body 52. In one aspect of the invention where cylindrical body 52 is made from a lower strength material such as a plastic, an elastomer, or wood, holes 78 and 80 may be provided by one or more mechanical inserts. For example, as shown in FIGS. 1 and 2, according to one aspect of the invention, holes 78' and 80' may be provided by perforated inserts 82 and 84. Perforated inserts 82 and 84 may comprise simply through holes 78' and 80' or may be threaded, for example, may comprise ¼×20 threads.

In one aspect of the invention, threads 74 on rod 58 and threads 76 on rod 60 may be oppositely threaded. In this aspect of the invention, having opposite threads, when cylindrical body 52 is rotated, the oppositely threaded rods 58 and 60 may either substantially simultaneously extend from cylindrical body 52 or substantially simultaneously retract into cylindrical body 52. According to this aspect of the invention, the substantially simultaneous extension or retraction of rods 58 and 60 causes the simultaneous deflection of brackets 48 and 49 and ends 20 and 22 of base plate 14. According to this aspect, the substantially simultaneously deflection of the ends 20 and 22 will provide for the substantially uniform curvature of the bottom surface 18 of base plate 14. According to one aspect of the invention, threads 74 of rod 58 and hole 78' of insert 82 may comprise right-handed threads, for example, ¼-inch UNC 20 threads, and threads 76 of rod 60 and hole 80' of inert 84 may comprise left-handed threads, for example, ¼-inch UNC 20 threads. In another aspect of the invention, these threads may be opposite.

In one aspect of the invention when connecting means 50 is adjustable, connecting means 50 may include a locking means for locking the adjustable connecting means into a desired positioned, for example, when bottom plate 18 has the desired curvature. In one aspect of the invention, the locking mean may comprise one or more lock nuts, for example, one or more wing nuts 86 mounted on threaded shafts 58 or 60. One or more washers 88 may be positioned between wing nut 86 and cylindrical body 52, for example, to aid in distributing the compressive upon insert 82.

According to one aspect of the invention, connecting means 50 may comprise a single rod, for example, a single rod 58 that engages cylindrical body 52 and bracket 62; that is, rod 60 may not be present. According to this aspect of the invention, cylindrical body 52 may be attached to end 22 of base plate 14; for example, end 56 of cylindrical body 52 may be mounted to end 22 of base plate 14. In this aspect, cylindrical body 52 may be rigidly mounted to end 22 of base plate 14 or rotatably mounted to end 22 of base plate 14, for example, via bracket 49. In one aspect of the invention, connecting means 50 having a single rod 58 may be non-adjustable, for example, single rod 58 may be substantially fixed to cylindrical body 52, or connecting means 50 having single rod 58 may be adjustable. In the aspect where connecting means 50 having a single rod is adjustable, single rod 58 may be threaded into cylindrical body 52 by one or more of the means discussed above with respect to the two-rod embodiment. According to this aspect of the invention, rotation of rigid body 52 about the rotatable mounting to, for example, bracket 49, causes rod 58 to extend and retract from cylindrical body 52 to vary the curvature of the bottom surface 18 of base plate 14.

Figure 12:
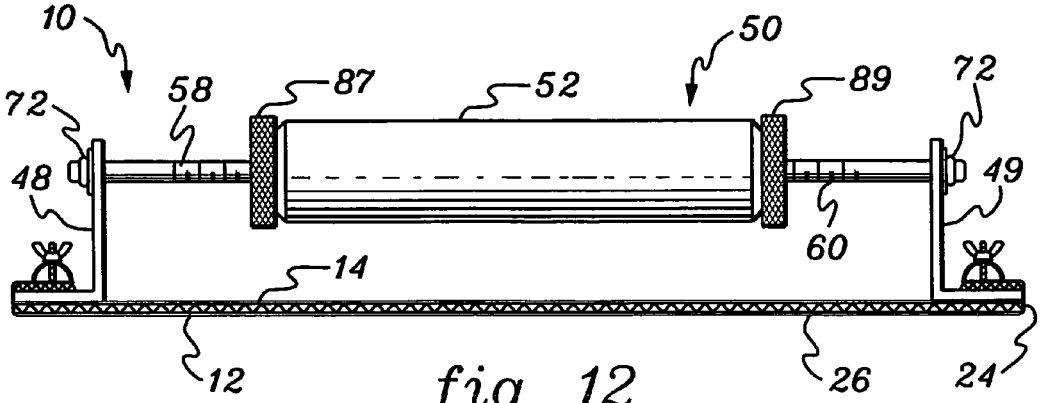
FIG. 12 is a front elevation view of the aspect of the invention shown in FIG. 1 in which the working surface is planer according to one aspect of the invention.
Figure 13:
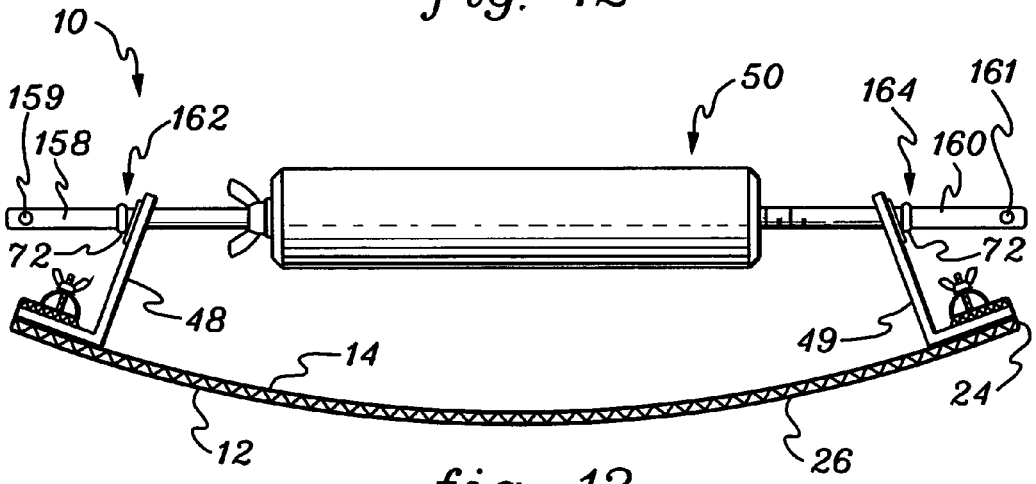
FIG. 13 is a front elevation view of the aspect of the invention shown in FIG. 1 in which the working surface is convex according to one aspect of the invention.
Figure 14:
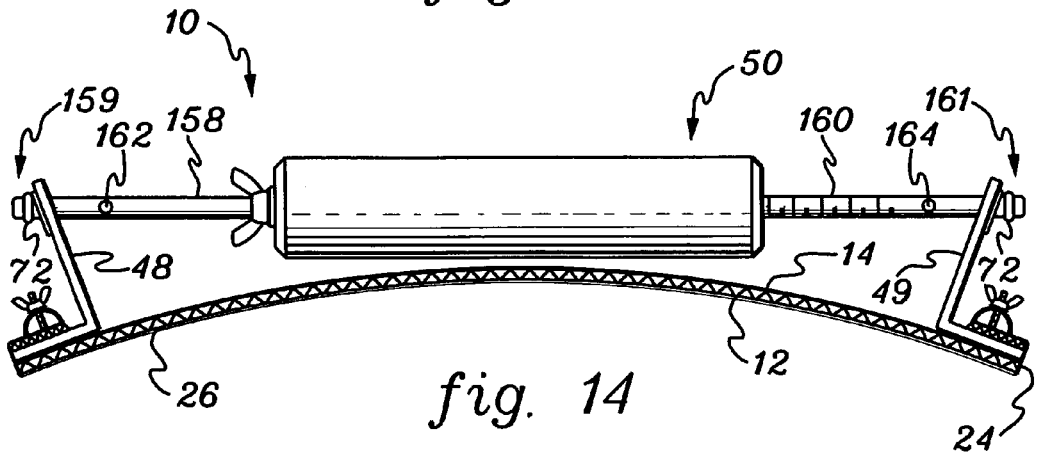
FIG. 14 is a front elevation view of the aspect of the invention shown in FIG. 1 in which the working surface is concave according to another aspect of the invention.

FIGS. 12, 13, and 14 illustrate representative shapes of the lower or working surface 26 according to aspects of the invention. FIG. 12 is a front elevation view of tool 10 shown in FIG. 1 in which the bottom surface 18 of base plate 14 and the bottom or working surface 26 of pad 24 are substantially flat or planer. According to this aspect of the invention, connecting means 50 may be substantially non-adjustable or adjustable to provide the substantially flat or planar surfaces.

FIG. 12 also illustrates an alternate means of locking the curvature of working surface 26, specifically; at least one knurled and threaded disks or nuts 87 and 89. Knurled disks 87 and 89 may be used to substantially lock the location of shafts 58 and 60 relative to cylindrical body 52 by tightening at least one of disks 87 and 89, for example, by hand, against the ends of cylindrical body 52. In one aspect, when using one or more disks 87 and 89, washers 70 may be omitted.

FIG. 13 is a front elevation view of the aspect of the invention shown in FIG. 1 in which the bottom surface 18 of base plate 14 and the bottom surface 26 of pad 24 are convex according to one aspect of the invention. Similarly, FIG. 14 is a front elevation view of the aspect of the invention shown in FIG. 1 in which the bottom surface 18 of base plate 14 and the bottom surface 26 of pad 24 are concave according to another aspect of the invention. According to these aspects of the invention, connecting means 50 may be substantially non-adjustable or adjustable to provide the convex or concave shape of the surfaces. For example, with reference to FIG. 1, cylindrical body 52 may be rotated whereby rods 58 and 60 extend from cylindrical body 52 displace brackets 48 and 49 and ends 20 and 22 of base plate 14 outward to provide the desired curvature. In this aspect of the invention, cylindrical body 52 may also be rotated in the opposite direction whereby rods 58 and 60 retract into cylindrical body 52 and displace brackets 48 and 49 and ends 20 and 22 of base plate 14 inward to provide the desired curvature. In one aspect of the invention, the deflection of rods 58 and 60 may be limited by contact between the ends of rods 58 and 60. In another aspect of the invention, rods 58 and 60 may interact where the deflection of rods 58 and 60 may not be limited by contact between rods 58 and 60. For example, in one aspect of the invention, rods 58 and 60 may be adapted where one rod passes into a cavity in the other rod; for instance, one rod may "telescope" into the other rod to allow for further displacement.

FIGS. 13 and 14 also illustrate an alternate means of engaging rods 58 and 60 with brackets 48 and 49. In one aspect of the invention, rods 58 and 60 may comprise rods 158 and 160 having at least two through holes for engaging cotter or hitch pins 72. Rods 158 and 160 may be threaded in a manner similar to rods 58 and 60 and engage cylindrical body 52, but in one aspect, rods 158 and 160 may be longer than rods 58 and 60. In this aspect, rods 158 and 160 include at least inner through holes 162 and 164 respectively, and outer through holes 159 and 161, respectively. In one aspect of the invention, inner through holes 162 and 164 may be used to engage cotter pin 72 when tool 10 assumes a convex working surface, see FIG. 13, and outer through holes 159 and 161 may be used to engage cotter pin 72 when tool 10 assumes a concave working surface, see FIG. 14. Three or more through holes 159 and 161 on each rod 158 and 160 may be used to further adjust the curvature of the working surface, as desired.

According to this aspect of the invention shown in FIGS. 13 and 14, in order to vary the curvature of working surface 26, having cotter pins 72 inserted in inner holes 162 and 164, tool 10 may be first adjusted to the planar position, for example, as shown in FIG. 12. Cotter pins 72 may then be removed from holes 162 and 164 and rods 158 and 160 and connecting means 50 may be removed from brackets 48 and 49. Rods 158 and 160 may be threaded in connecting means 50 wherein outer holes 159 and 161 are positioned adjacent to brackets 48 and 49, respectively. Connecting means 50 may then be reassembled into brackets 48 and 48 and cotter pins 72 may be inserted into outer holes 159 and 161 whereby cotter pins 72 are positioned inboard of brackets 48 and 49. Adjustable connecting means 50 may then be used to extend rods 158 and 160 whereby cotter pins 72 contact and deflect brackets 48 and 49 and also vary the curvature of working surface 26 as desired. Tool 100 may be readjusted by reversing this procedure.

According to aspects of the present invention, the radius of curvature R of the convex or concave working surface of tool 10 may vary from about 3 inches to infinity, that is, a substantially planar surface. However, in one aspect of the invention, the convex or concave radius of curvature of tool 10 may range from about 6 inches to about 6 feet, but is typically between about 9 inches and about 2 feet. In one aspect of the invention, the design of brackets 48 and 49, for example, their height or width, may be varied to accommodate a desired convex or concave curvature.

Tool 10 can be used effectively to abrade any surface, for example, any surface requiring the removal of material to provide for a smoother surface. In one aspect of the invention, tool 10 may be used to abrade hardened joint compound from drywall or sheet rock, or similar structural material, or abrade hardened plaster, or abrade foam-like materials, for example, from non-planar surfaces, such as arches, in residential, commercial, and industrial installations. Tool 10 may also be used in smooth filler compounds for automobile bodywork. However, the skilled artisan will recognize that tool 10 may be used in any residential, commercial, or industrial application where the removal of material from a surface by abrasion is desired. In one aspect of the invention, tool 10 comprises a single-handed tool, that is, a tool that can be used effectively by a mechanic using a single hand. In another aspect of the invention, tool 10 may be manipulated by a robotic arm-end, for example, in industrial applications. In this aspect of the invention, it will also be apparent to the artisan that cylindrical body 52 may be adapted to accommodate whatever arm-end tooling is being used.

Figure 15:
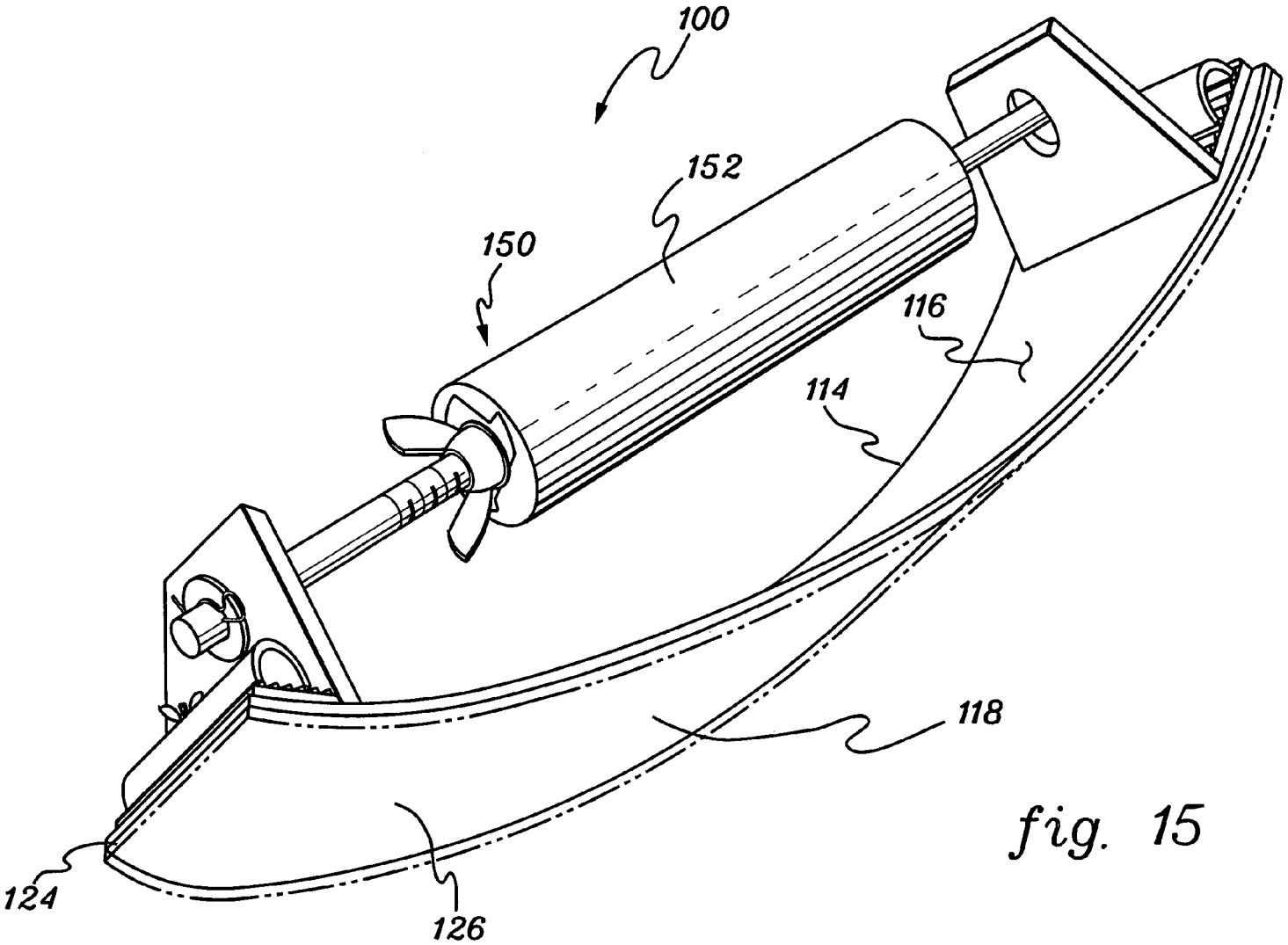
FIG. 15 is a perspective view of a tool for applying a material to a surface according to another aspect of the invention.

FIG. 15 is a perspective view of a tool 100 for applying a material to a surface according to another aspect of the invention. Tool 100 is similar to and includes all the properties of tool 10 shown in FIGS. 1, 2, 12, 13, and 14. Tool 100 includes a base plate 114, for example, a flexible base plate, and an adjustable or non-adjustable connecting means 150 similar to connecting means 50 having a cylindrical body 152. However, in contrast to tool 10, tool 100 may not have a pad 24. According to one aspect of the invention, tool 100 includes a smooth lower or working surface 118 on base plate 114, similar to lower surface 18 of tool 10. In another aspect of the invention, tool 100 may include a pad 124, for example, a resilient pad 124 (shown in phantom), similar to pad 24 of tool 14 and having all the properties of pad 24 including having a bottom or working surface 126. However, according to this aspect, bottom surface 126 may not have recesses 28 and ribs 30. For example, in one aspect, tool 100 having a resilient pad 124 may have a smooth surface 126 and may comprise a "float"-like device, for example, for "floating" concrete. In another aspect, tool 100 may be used for applying a material to a surface and may include pad 124 having recesses 28 and 30, for example, one or more of the recesses and ribs and patterns shown in FIGS. 1 through 11 for tool 10. IN one aspect, with or without pad 124, tool 100 may be used to spread or apply drywall compound or auto body filler, among other materials.

Tool 100 may be used to apply or spread a material on a surface. For example, tool 100 may be used to apply a paint, a coating, a grout, or an adhesive, among other spreadable materials, to a surface, for example, a smooth layer of material. For example, in one aspect, the material to be applied to a surface may be first applied to the lower surface 118 or to the surface being treated and then spread as needed, for example, substantially uniformly spread using tool 100. In one aspect of the invention, tool 100 may include recesses 28 and ribs 30 and be used to apply an uneven layer of material to a surface, for example, when applying an adhesive, such as a mastic-type adhesive, for instance, for installing tile or marble to a wall or floor. In one aspect of the invention, tool 100 comprises a single-handed tool, that is, a tool that can be used effectively by a mechanic using a single hand. In another aspect of the invention, tool 100 may be manipulated by a robotic arm-end, for example, in industrial applications. In this aspect of the invention, it will be apparent to the artisan that cylindrical body 152 may be adapted to accommodate whatever arm-end tooling is being used.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A tool for supporting an abrasive material, the tool comprising:

a flexible base plate having an upper surface, a lower surface, a first end, and a second end;

a handle mounted between the first end and the second end, the handle comprising an adjustable connecting means adapted to deflect at least one of the first end and the second end of the flexible base plate to thereby vary the curvature of the lower surface of the flexible base plate;

a pad mounted to the lower surface of the base plate, the pad comprising a surface having at least some recesses; and means for mounting an abrasive sheet material upon the surface of the pad.

2. The tool as recited in claim 1, wherein the pad comprises a resilient pad.

3. The tool as recited in claim 1, further comprising:

a first bracket mounted proximate the first end; and a second bracket mounted proximate the second end;

wherein the adjustable connecting means engages the first bracket and the second bracket.

4. The tool as recited in claim 1, wherein the adjustable connecting means comprises a rotatable cylindrical body having a first end and a second end and at least one first rod extending from the first end of the cylindrical body to a first bracket mounted proximate the first end.

5. The tool as recited in claim 4, wherein the adjustable connecting means further comprises a second rod extending from the second end of the handle to the second bracket.

6. The tool as recited in claim 1, wherein the tool comprises a single-hand hand tool.

7. The tool as recited in claim 4, wherein the rotatable, cylindrical body comprises a single rotatable cylindrical handle.

8. The tool as recited in claim 1, wherein the at least some recesses comprises a regular pattern of recesses.

9. The tool as recited in claim 1, wherein the at least some recesses comprises a plurality elongated recesses.

10. A method of abrading a surface using a tool comprising:

a pad having an surface having a plurality of recesses;

means for varying the curvature of the surface of the pad; and a perforated abrasive sheet material mounted upon the pad;

the method comprising:

adjusting the curvature of the surface to a desired curvature;

passing the perforated abrasive sheet material across the surface wherein abraded surface material is produced;

allowing the abraded surface material to pass through the perforations of the perforated abrasive sheet material; and collecting at least some of the abraded surface material in at least some of the plurality of recesses in the pad to minimize the build-up of abraded surface material on the surface of the perforated abrasive sheet material.

11. The method as recited in claim 10, wherein the plurality of recesses comprises a plurality of elongated recesses, and wherein the method further comprises discharging the abraded surface material from the plurality of elongated recesses.

12. A hand tool for supporting an abrasive material, the hand tool comprising:

a flexible base having an upper surface, a lower surface, a first end, and a second end;

a rotatable cylindrical handle having a first end and a second end, the handle comprising an adjustable connecting means mounted between the first end and the second end, the adjustable connecting means adapted to deflect the first end and the second end of the flexible base wherein the curvature of the lower surface of the flexible base is varied;

a resilient pad mounted to the lower face of the flexible base, the resilient pad having a plurality of elongated recesses; and a first clamp mounted proximate the first end and a second clamp mounted proximate the second end, the first clamp and the second clamp adapted to retain a perforated abrasive sheet material upon the resilient pad.

13. The hand tool as recited in claim 12, further comprising a first bracket mounted proximate the first end; and a second bracket mounted proximate the second end; and wherein the adjustable connecting means further comprises at least one first rod extending from the first end of the handle to the first bracket.

14. The hand tool as recited in claim 12, wherein the adjustable connecting means further comprises a second rod extending from the second end of the handle to the second bracket.

15. The tool as recited in claim 1, wherein the adjustable connecting means is adapted to deflect the first end and the second end of the flexible base plate.

16. The tool as recited in claim 1, wherein the curvature comprises one of a concave curvature and a convex curvature.

17. The tool as recited in claim 1, wherein the curvature comprises a radius of curvature of about 3 inches to about 6 feet.

18. The method of claim 10, wherein adjusting the curvature of the surface to a desired curvature comprises adjusting the curvature of the surface to one of a convex and a concave curvature.

19. The hand tool as recited in claim 12, wherein the adjustable connecting means is adapted to deflect the first end and the second end of the flexible base wherein the curvature of the lower surface of the flexible base is one of concave and convex.

20. A tool for supporting an abrasive material, the tool comprising:

a flexible base plate having an upper surface, a lower surface, a first end, and a second end;

a handle mounted between the first end and the second end, the handle comprising an adjustable connecting means adapted to deflect at least one of the first end and the second end of the flexible base plate to thereby vary the curvature of the lower surface of the flexible base plate;

a pad mounted to the lower surface of the base plate; and means for mounting an abrasive sheet material upon the surface of the pad;

wherein the adjustable connecting means comprises a single rotatable cylindrical handle having a first end and a second end and at least one first rod extending from the first end of the cylindrical handle to a first bracket mounted proximate the first end.

21. The tool as recited in claim 20, wherein the pad comprises a surface having at least some recesses.

* * * * *